US006585029B1

(12) United States Patent
Flick et al.

(10) Patent No.: US 6,585,029 B1
(45) Date of Patent: Jul. 1, 2003

(54) CONTINUOUS CASTING MOLD

(75) Inventors: Andreas Flick, Linz (AT); Gernot Lettmayr, St. Florian (AT); Helmut Eidinger, Schoenering (AT); Franz Wimmer, Riedau (AT); Werner Jahn, Linz (AT); Josef Watzinger, Reichenau (AT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/857,545

(22) PCT Filed: Nov. 2, 1999

(86) PCT No.: PCT/AT99/00258

§ 371 (c)(1),
(2), (4) Date: Jun. 6, 2001

(87) PCT Pub. No.: WO00/38857

PCT Pub. Date: Jul. 6, 2000

(30) Foreign Application Priority Data

Dec. 23, 1998 (AT) ..... 2167/98

(51) Int. Cl.[7] ..... B22D 11/10

(52) U.S. Cl. ..... 164/418; 164/491; 164/436; 164/459

(58) Field of Search ..... 164/418, 491, 164/436, 459

(56) References Cited

U.S. PATENT DOCUMENTS 5,279,354 A * 1/1994 Grove ..... 164/491
5,520,242 A * 5/1996 Streubel et al. ..... 164/418
5,730,207 A * 3/1998 Pleschiutschnigg ..... 194/459
5,799,719 A * 9/1998 Wimmer et al. ..... 164/418
6,145,580 A * 11/2000 Lamberti et al. ..... 164/418
6,382,304 B1 * 5/2002 Genge ..... 164/491

FOREIGN PATENT DOCUMENTS

| | | |
|---|---|---|
| AT | 404235 | 9/1998 |
| DE | 2620751 | 11/1977 |
| DE | 3501422 | 8/1985 |
| DE | 4403050 | 9/1985 |
| EP | 0658387 | 6/1995 |

* cited by examiner

*Primary Examiner*—Tom Dunn
*Assistant Examiner*—Irh. Lin
(74) *Attorney, Agent, or Firm*—Ostrolenk, Faber, Gerb & Soffen, LLP

(57) ABSTRACT

A continuous casting mold for continuous casting of a steel billet. Opposite spaced apart wide side walls and opposite spaced apart narrow side walls between the wide side walls and clampable at the wide side walls and also displacable along the wide side walls transversely to the casting direction, the narrow side walls being narrow wedged-shaped in the casting direction. A funnel-shaped pouring-in region defined in the wide side walls. The wide side walls converge in the casting direction. The distance between the wide side walls at the mold end is constant over the entire width of the side walls allowing at least one of the wide side walls is supported to be displaceable and tiltable with respect to the other wide side wall by an adjusting device.

21 Claims, 4 Drawing Sheets

Fig. 5:
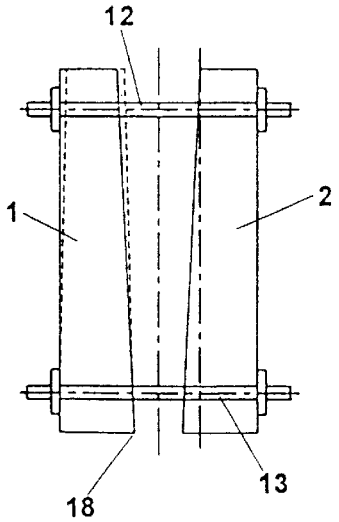
Fig. 6:
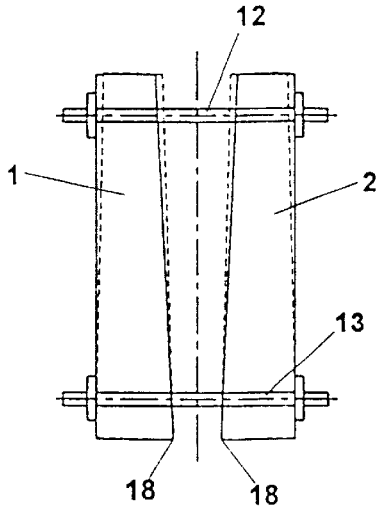
Fig. 7a:
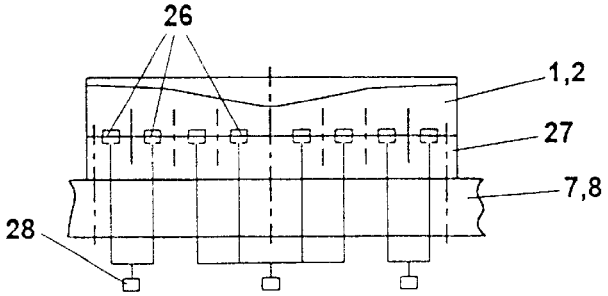
Fig. 7b:
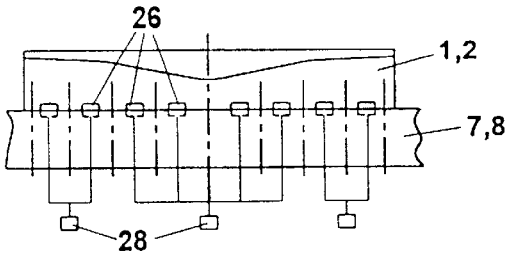
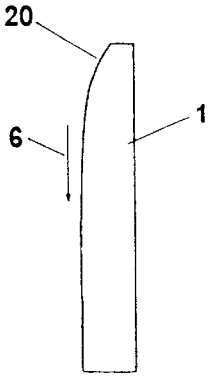
Fig. 8:
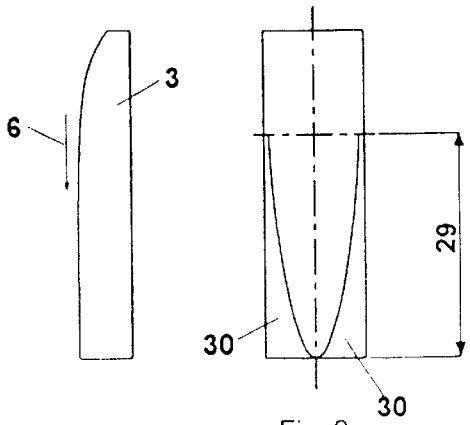
Fig. 9:

CONTINUOUS CASTING MOLD

BACKGROUND OF THE INVENTION

The invention relates to a continuous casting mold for the continuous casting of a steel billet, preferably for the casting of thin slabs of a thickness of less than 100 mm, with wide side walls located opposite one another and with narrow side walls which are arranged clampably between the wide side walls and displaceably along the wide side walls transversely to the casting direction and are located opposite one another and which narrow in a wedge-shaped manner in the casting direction. The wide side walls have a funnel-shaped pouring-in region which extends in the casting direction as far as the mold end, and the distance between the wide side walls is reduced continuously, at least over part regions of their extent, in the direction of the narrow side walls and in the casting direction, and the wide side walls are designed to converge.

A continuous casting mold of the generic type is already known from DE-C 35 01 422. Its wide side walls are designed to converge in the direction of the narrow side walls and in the casting direction. The wide side walls have, in the region of adjustment of the narrow side walls, planar contact faces which cooperate with the side walls of the narrow side walls. When format adjustment is to be carried out in the mold, this usually involves a displacement of the narrow side walls with the effect of changing the width of the steel billet to be cast.

The billet thickness and consequently the distance between the wide side walls are in this case to be kept constant. However, during format adjustment of the known continuous casting mold, it is possible to keep the distance between the wide side walls constant only when the narrow side walls are offset both in the horizontal and in the vertical direction. Designing the wide side walls in the region of adjustment of the narrow side walls with a planar surface makes it necessary for the latter to be in a skew position with respect to the mold longitudinal axis. Due to these geometric restrictions, it is no longer possible for the exit cross section to be configured in such a way that, for each billet format to be cast, the billet thickness is constant over the entire billet width.

EP 0 658 387 A1 also discloses a continuous casting mold, the wide side walls of which are designed to converge in part regions in the direction of the narrow side walls and in the casting direction. The wide side walls have, in the region of adjustment of the narrow side walls, planar surface contours which cooperate with the side faces of the narrow side walls and the distance between which decreases linearly in the direction of the narrow side walls and is constant in the casting direction. In the event of a displacement of the narrow side walls with the effect of changing the wide sides of the steel billet to be cast, this embodiment also automatically necessitates an adjustment of the thickness of the latter in a ratio permanently predetermined by the geometry. However, the range of billet formats to be cast by means of a continuous casting mold of this type is consequently restricted in an undesirable way.

SUMMARY OF THE INVENTION

The object of the invention is, therefore, to avoid these disadvantages described above and to propose a continuous casting mold with a funnel-shaped pouring-in region, said mold allowing format adjustment in which the billet width of the billet to be cast can be set without any repercussion on the billet thickness and the billet thickness of the billet to be cast can be kept constant over the entire billet width.

This object is achieved, according to the invention, in that the distance between the wide side walls at the mold end is constant over the entire width of the wide side walls and at least one of the wide side walls is arranged on a mold carrying structure displaceably and tiltably with respect to the opposite wide side wall and is connected to an adjusting device. As compared with funnel molds in which the wide side walls are located opposite one another in a plane-parallel manner in the region of adjustment of the narrow side walls, the converging run of the wide side walls in the region of adjustment results in smaller curvatures in the funnel-shaped pouring-in region and consequently in the easy formation of a billet shell.

The proposed mold geometry, aimed particularly at the low-stress and therefore crack-free formation of a billet shell, gives rise, during format adjustment, to a wedge-shaped gap between the wide side wall and the narrow side wall, which, however, amounts at most to only a few millimeters and can easily be compensated by means of the tilting movement of the wide side wall. If one of the two wide side walls located opposite one another is firmly anchored on the mold carrying structure and thus forms a fixed side, the narrow side wall arranged between these two walls is also tilted by means of the displaceable and tiltable wide side wall and in this way a gap-free mold cavity for the reception of melt is formed for each adjustable billet format.

The tilting of the narrow side walls when they are clamped between the wide side walls is avoided and the necessary tilting angle for the wide side wall is halved when each of the wide side walls is arranged displaceably and tiltably on a mold carrying structure and is connected to an adjusting device.

In an expedient embodiment of the continuous casting mold, the wide side walls located opposite one another are connected to an adjusting device covering both wide side walls. In a special design solution, the tiltable wide side wall is connected to the adjusting device in an articulated manner.

Optimum conditions in the continuous casting mold are obtained for the formation of a billet shell when, with respect to a horizontal plane incorporating the casting level under constant casting conditions, the inclination $_1$ of the wide side wall in the funnel-shaped pouring-in region is 1° to 5° and the inclination $_2$ of the wide side wall in the region of adjustment of the narrow side wall is between 0.1° and 0.3°.

In continuous casting technology, it is generally customary to clamp the narrow side walls between the wide side walls by means of a casting cone which is format-dependent, that is to say dependent on the casting width, the casting cone being adapted during format adjustment to the new billet format in each case. According to the teaching given in DE-C 35 01 422, it is advantageous for the narrow side walls to be arranged between the wide side walls in a position in which they diverge from one another in the casting direction. Both the mass flow of the steel in the direction of the narrow side walls and the cooling-related contraction of the billet may be taken into account in defining the casting cone.

A simple design of the continuous casting mold according to the invention is achieved in that each wide side wall is fastened releasably to a supporting wall and the adjusting device is connected to at least one of the supporting walls, which are displaceable and tiltable jointly with the wide side wall. The coolant ducts for mold cooling are worked into the wide side wall or the supporting wall in the form of coolant slots along the contact plane between the wide side wall and the supporting wall.

According to an alternative embodiment, a carrier wall is arranged between the wide side wall and the supporting wall, the wide side wall being fastened releasably to the carrier wall and the carrier wall being fastened releasably to the supporting wall. The coolant ducts for mold cooling are worked into the wide side wall or into the carrier wall in the form of coolant slots along the contact plane between the wide side wall and the carrier wall. By means of this embodiment, it is possible to preassemble the wide side wall jointly with the carrier wall and with the integrated coolant lines as a structural unit and to install it in the continuous casting mold in a simple way.

In order to meet the need for discharging the heat in the continuous casting mold differently in different zones, it is proposed, according to a preferred embodiment, that the geometry of the coolant ducts in the funnel-shaped pouring-in region of the wide side walls and the geometry of the coolant ducts in the region of adjustment of the narrow side walls be different. What is to be understood by the geometry of the coolant ducts is, on the one hand, the distance between the coolant ducts and, on the other hand, the clear width (cross-sectional area) of the coolant ducts and consequently the coolant flow velocity or the combination of the two influencing variables. The specific heat flux density of the wide side walls is varied as a result of both measures. According to a further possible embodiment, this is achieved in that groups of adjacent coolant ducts are conductively connected to individually activatable coolant stations, the funnel-shaped pouring-in region and the regions of adjustment of the narrow side walls of each wide side wall each being assigned at least one coolant supply station.

In order to allow an optimum discharge of heat in the continuous casting mold, it is advantageous for at least those inner walls of the wide side walls which form the mold cavity to be formed by different materials in the casting direction, the material used in the region of the casting level having a lower thermal conductivity than the material used for the portion of the wide side walls which follows in the casting direction. For example, in the region of the casting level, where particularly high temperatures occur and solidification is not required immediately, the wide side walls consist of nonferrous metals, refractory materials or various combinations of these.

It is particularly cost-effective and operationally reliable to equip the adjusting devices for the wide side walls and the narrow side walls with electromechanical or hydraulic drives.

Favorable conditions for the starting operation and for stress-free formation of a billet shell are likewise obtained when the contour of the wide side walls in the funnel-shaped pouring-in region is shaped parabolically in the casting direction. A further improvement in these conditions arises when the contour of the narrow side walls is also shaped parabolically in the casting direction and the narrow side walls are provided on both sides with edge clearances in a region which extends below the casting level as far as the mold exit.

Further advantages and features of the present invention may be gathered from the following description of unrestrictive exemplary embodiments, reference being made to the accompanying diagrammatic figures, which show the following:

DESCRIPTION OF THE DRAWINGS

FIG. 5 shows, in a vertical section along the line A—A of FIG. 3, the displacement of the movable wide side wall in the case of a continuous casting mold according to the embodiment shown in FIGS. 1 and 3, FIG. 6 shows, in a vertical section along the line B—B of FIG. 4, the displacement of the movable wide side walls in the case of a continuous casting mold according to FIGS. 2 and 4, FIG. 7*a* shows a diagrammatic illustration of the design of a mold wide side in a first embodiment, with one possible embodiment of the coolant supply, FIG. 7*b* shows a diagrammatic illustration of the design of a mold wide side in a second embodiment, with one possible embodiment of the coolant supply, FIG. 8 shows the cross section of a wide side wall in the funnel-shaped pouring-in region with a parabolic inner contour, FIG. 9 shows the cross section of a narrow side wall with a parabolic inner contour and with edge clearance.

DESCRIPTION OF THE PREFERRED EMBODIMENTS

Figure 1:
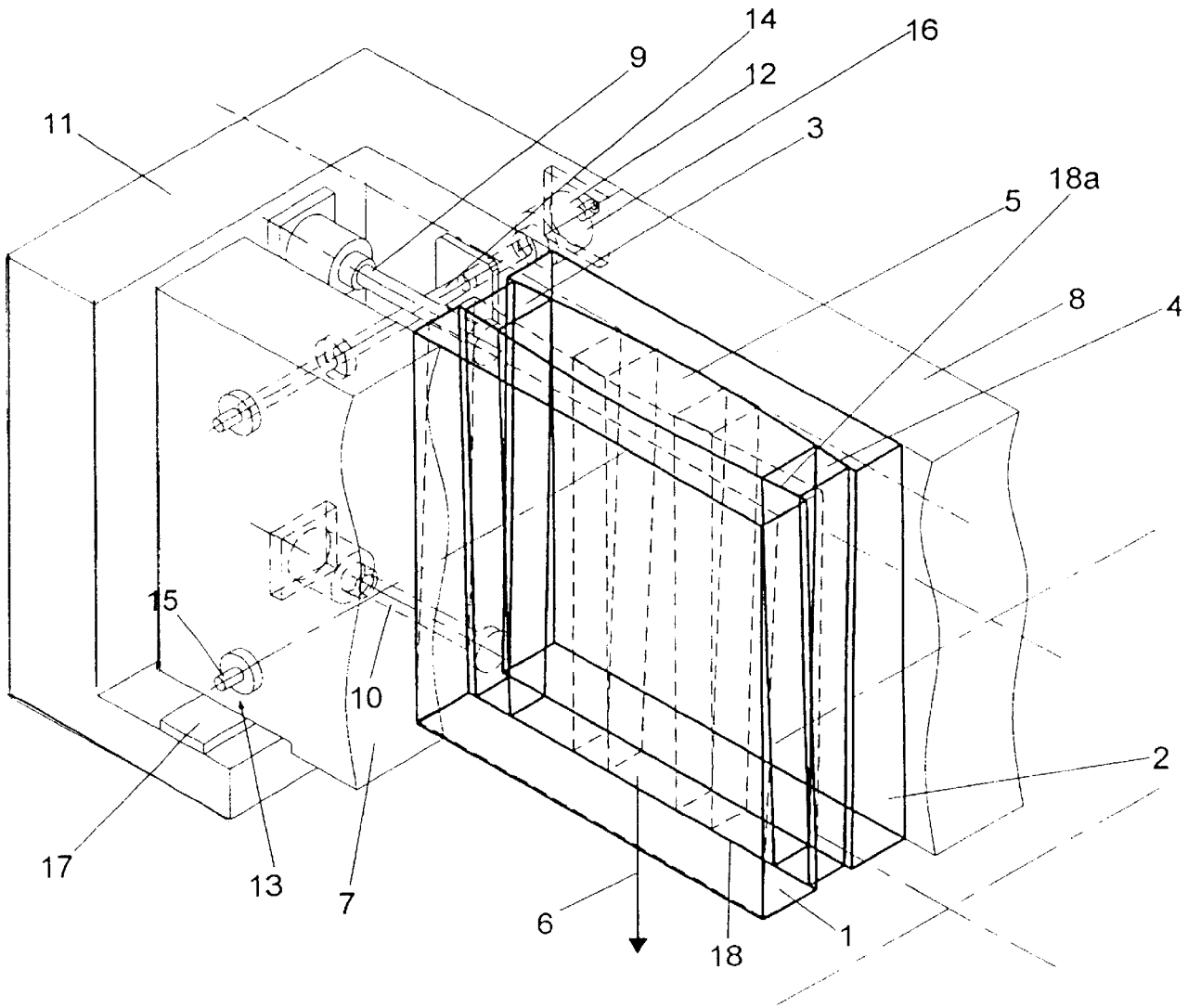
FIG. 1 shows a first embodiment of the continuous casting mold according to the invention with one fixed side and one loose side.
Figure 2:
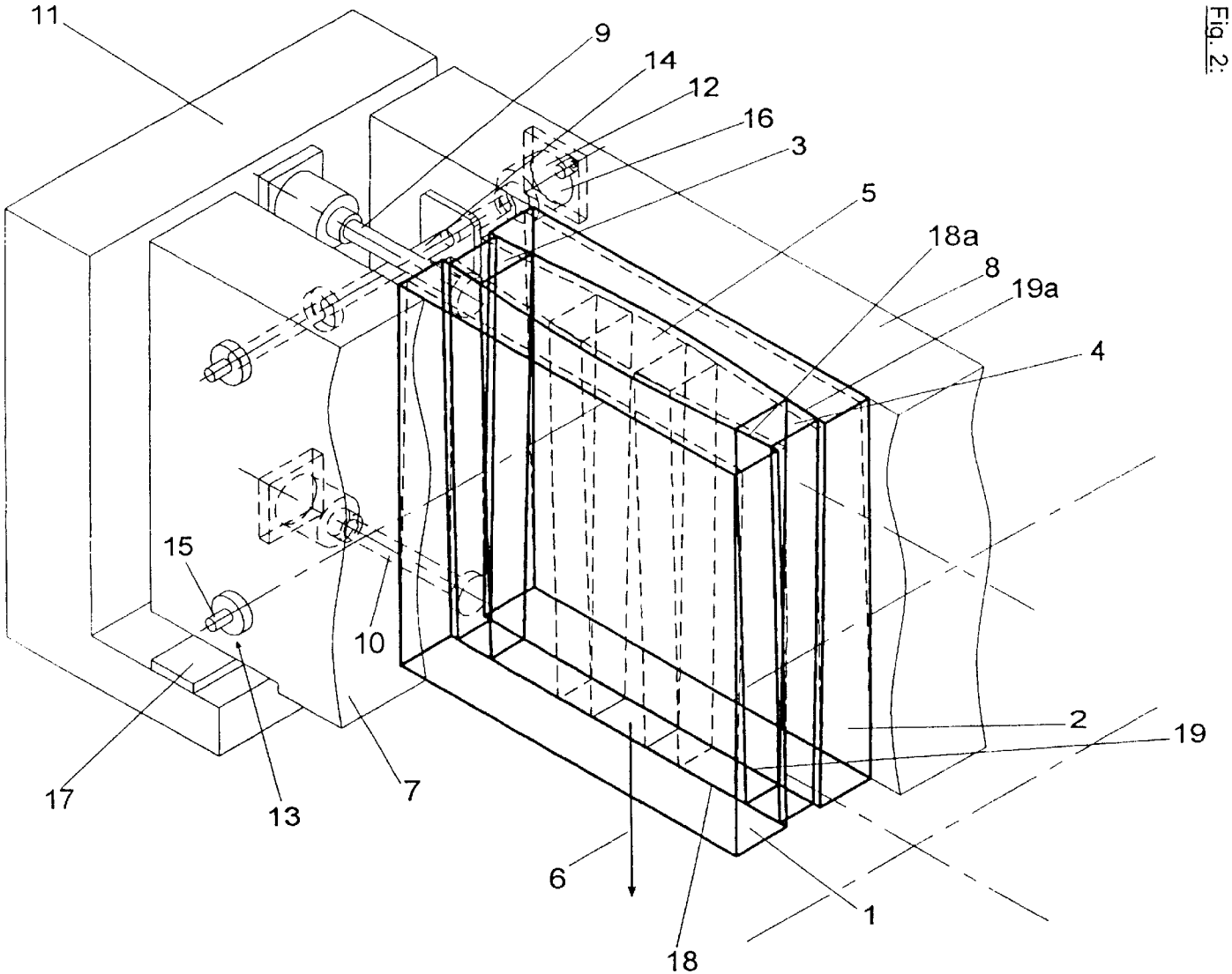
FIG. 2 shows a second embodiment of the continuous casting mold according to the invention with two loose sides.

FIGS. 1 and 2 illustrate diagrammatically two basic embodiments of continuous casting molds according to the invention for the production of a steel billet, identical components being given identical reference symbols. Two wide side walls 1, 2 and two narrow side walls 3, 4 of a continuous casting mold form a mold cavity 5, into which steel melt is introduced via a pouring spout, not illustrated, and out of which a partially solidified steel billet is conveyed from the continuous casting mold in the casting direction. The wide side walls 1, 2 and the narrow side walls 3, 4 are conventionally produced from copper or a copper alloy or from another material having very good thermal conductivity. The wide side walls 1, 2 are supported on supporting walls 7, 8 and are screwed to these. In a similar way, the narrow side walls 3, 4 are supported on and screwed to supporting walls, not illustrated. In order to set different casting formats, the narrow side walls 3, 4 positioned between the wide side walls 1, 2 are displaceable transversely to the casting direction 6, one possible position being illustrated by broken lines. For carrying out this adjusting movement, the narrow side walls 3, 4 are connected by their vertical end regions to narrow-side adjusting devices 9, 10 in an articulated manner and are counter mounted on the firmly anchored mold carrying structure 11. These narrow-side adjusting devices are not illustrated for the narrow side wall 4. The mutually opposite supporting walls 7, 8 of the wide side walls 1, 2 have passing through them tie rods 14, 15 of the adjusting devices 12, 13 and are capable of being fixed relative to one another, the narrow wide side walls 3, 4 being clamped or released between the wide side walls 1, 2 when action is taken on these adjusting devices 12, 13. For carrying out these manipulations, each adjusting device 12, 13 is assigned a separately activatable pressure-medium cylinder 16. The narrow side walls 3, 4 are narrowed in a wedge-shaped manner in the casting direction 6. In principle, the adjusting devices 9, 10, 12, 13 may be equipped with any desired electromechanical or hydraulic drives.

In the embodiment of the continuous casting mold illustrated in FIG. 1, the wide side wall 2 is designed as a fixed side, that is to say it occupies, together with the supporting wall 8, a clearly defined position in relation to the mold carrying structure 11. The loose side formed by the wide side wall 1 and the associated supporting wall 7 is supported on guides 17 in the mold carrying structure 11 so as to be displaceable transversely to the casting direction 6 and is capable of being pressed by means of the adjusting devices 12, 13 against the narrow side walls 3, 4 and, together with these, against the firmly positioned wide side wall 2, this taking place as a result of displacement in the direction of the guides 17 and tilting about the lower or upper inner edge 18, 18*a* of the wide side wall 1.

In the embodiment of the continuous casting mold illustrated in FIG. 2, both wide side walls 1, 2 are designed as loose sides and are supported on guides 17 in the mold carrying structure 11 so as to be displaceable transversely to the casting direction 6 and are capable of being pressed by means of the adjusting devices 12, 13 on both sides against the narrow side walls 3, 4, this taking place as a result of displacement in the direction of the guides 17 and tilting about the lower or upper inner edge 18, 18*a*, 19, 19*a* of the wide side walls 1, 2.

Figure 3:
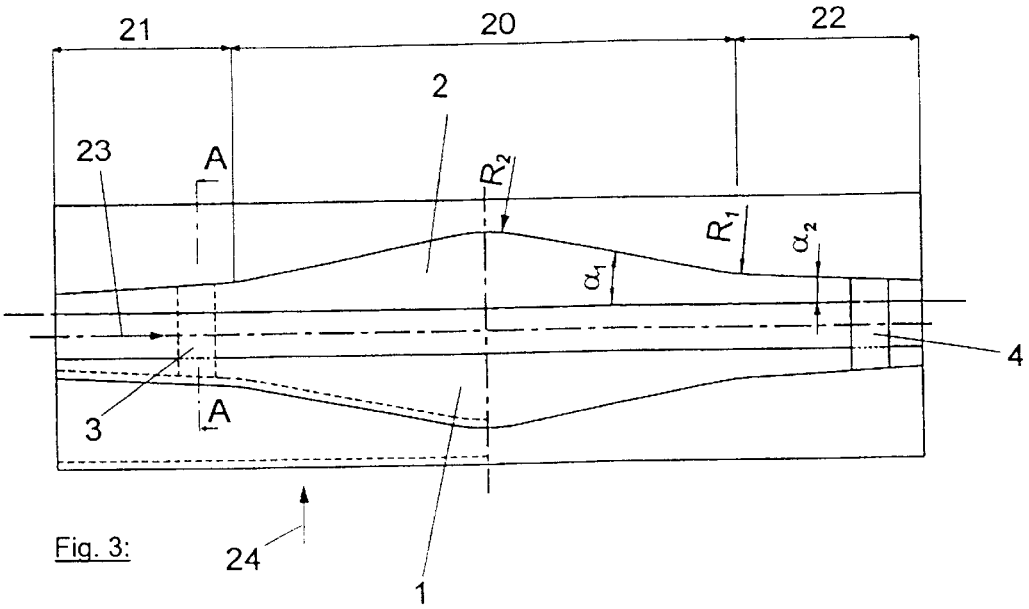
FIG. 3 illustrates, in a half section, the mold geometry in the case of a continuous casting mold according to the first embodiment and the displacement of the mold walls during format adjustment.
Figure 4:
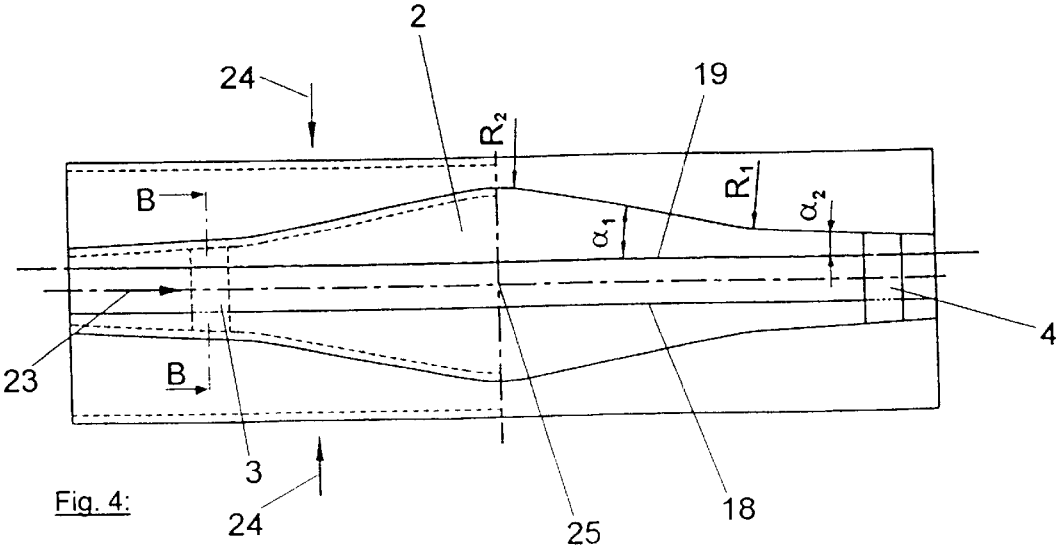
FIG. 4 illustrates, in a half section, the mold geometry in the case of a continuous casting mold according to the second embodiment and the displacement of the mold walls during format adjustment.

FIGS. 3 and 4 show, in a horizontal section through the continuous casting molds according to FIGS. 1 and 2, which is taken in the region of the casting level, the geometric conditions in this region of the continuous casting mold and their variations during format adjustment. What is designated in this context by casting level is the surface of the liquid melt introduced into the continuous casting mold, this casting level always being kept at approximately the same height in the continuous casting mold under constant casting conditions.

In order to achieve a clear illustration, only the inner edges of the wide side walls 1, 2 are illustrated in FIGS. 3 and 4. The centrally placed funnel-shaped pouring-in region 20 has adjoining it on both sides a region of adjustment of the narrow side walls 21, 22, the narrow side walls 3, 4 being positioned displaceably within this region of adjustment.

In FIG. 3, the narrow side wall 4 is illustrated by unbroken lines for a first billet format and the wide side walls 1, 2 are adapted to this with likewise unbroken lines. The narrow side wall 3 is illustrated by broken lines in the left half of the figure for a smaller billet format. The displacement movement of the narrow side wall 3 is indicated by the arrow 23 which symbolizes the narrow-side adjusting devices 9, 10 from FIG. 1. The wide side wall 1 is designed as a loose side and is tilted and pressed down in the direction of the arrow 24, which symbolizes the adjusting devices 12, 13 from FIG. 1, toward the fixed side formed by the wide side wall 2, as illustrated by broken lines. The tilting movement takes place, here, about the lower inner edge 18 of the wide side wall 1. The lower inner edge 18, which defines a portion of the exit cross section from the continuous casting mold, does not change its position as a result of format adjustment, so that the billet thickness in the exit cross section always remains constant, unchanged by desired billet formats. In FIG. 5, the change in position of the wide side wall 1, brought about by the tilting movement about the lower inner edge 18, is illustrated by broken lines.

FIG. 4 illustrates in a similar way the conditions in the situation where both wide side walls 1, 2 form two loose sides, as already illustrated in FIG. 2. In this case, during format adjustment, which is made clear by the narrow side wall 3 illustrated by broken lines, there is a synchronous tilting of the two wide side walls 1, 2 into the position illustrated by broken lines in the left half section. The entire continuous casting mold remains in a position symmetrical to the central casting axis 25. The narrow side walls 3, 4 do not change their vertical orientation. FIG. 6 illustrates by broken lines the changes in position of the two wide side walls 1, 2 which are brought about by the tilting movement about the lower inner edges 18.

The planar wall inner parts of the wide side walls 1, 2, which have different inclinations to one another, are matched by means of arcuate transitions $R_1$, $R_2$. The inclination $_1$ of the wide side walls 1, 2 in the funnel-shaped pouring-in region 20 is in the region of 1 to 5° and the inclination $_2$ of the wide side walls in the region of adjustment of the narrow side walls 21, 22 is in the region of 0.10 to 0.30. The best possible conditions for the formation of a billet shell are thus afforded.

The structural design of the wide side of a continuous casting mold is illustrated diagrammatically in FIGS. 7*a* and 7*b*. Each wide side wall 1, 2 is fastened either directly to a supporting wall 7, 8 releasably by means of screw connections (FIG. 7*b*) or to said supporting wall, with a carrier wall 27 interposed, and both walls are jointly fastened releasably to a supporting wall 7, 8 (FIG. 7*a*). Coolant ducts 26 are worked into each wide side wall 1, 2 in a groove-shaped manner, so as to be parallel to one another and to follow the casting direction vertically. However, they may also be worked into the supporting wall 7, 8 or carrier wall 27 resting against the wide side wall, as described above with regard to the wide side wall. This variant is illustrated by broken lines in FIGS. 7*a* and 7*b*. In order to achieve a cooling action which is different in different sections, the geometry of the coolant ducts 26 deviates in their cross section and/or the distance between them in the funnel-shaped pouring-in region from the region of adjustment of the narrow side walls. The same effect can be achieved when the coolant ducts 26 are connected in groups to coolant supply stations 28, with the result that the throughflow velocity in the coolant ducts 26 becomes variable.

The wide side walls 1, 2 are designed parabolically in the casting direction 6 in the funnel-shaped pouring-in region 20 (FIG. 8). As illustrated in FIG. 9, the narrow side walls 3, 4 have a surface contour which, in particular, is designed parabolically on the pouring-in side, edge clearances 30 being additionally arranged on both sides in a region 29 which extends below the casting level as far as the mold exit. These edge clearances are already described in detail in AT-B 404 235.

What is claimed is:

1. A continuous casting mold for continuous casting of a thin slab steel billet, the mold comprising:

a pair of wide side walls spaced apart and opposite each other;

a pair of narrow side walls spaced apart, and opposite each other, arranged clampably between the wide side walls and also displacable along the wide side walls in a direction transverse to a casting direction of the mold, the narrow side walls both narrowing in a wedge shape in the casting direction;

the wide side walls together being shaped and oriented to define a funnel shaped pouring-in region which extends in the casting direction;

the wide side walls being positioned by the narrow side walls so that the distance between the wide side walls continuously narrows at least over part regions of the extent of the wide side walls, in the direction of the narrowing of the narrow side walls and the casting direction, whereby the wide side walls converge in the direction of the narrow side walls;

the wide side walls extending to an end of the mold in the casting direction, the wide side walls having a distance between them at the end of the mold in the casting direction, which distance is constant over the entire width of the wide side walls;

at least one supporting wall at one of the wide side walls and the one wide side wall being releasably fastened to the at least one supporting wall;

an adjusting device connected to the at least one supporting wall for adjusting the displacement and tilt of the one supporting wall jointly with the respective wide side wall thereto fastened, such that the at least one supporting walls and the thereto fastened wide side wall is tiltable with respect to the opposite wide side wall.

2. The continuous casting mold of claim 1, wherein there are two of the supporting walls spaced apart and opposite each other and each supporting wall being respectively positioned for having a respective one of the wide side walls releasably fastened thereto;

the adjusting device being connected to at least one of the supporting walls for adjusting the displacement and tilt of the supporting walls to which the adjusting device is connected.

3. The continuous casting mold of claim 2, wherein each of the wide side walls and the supporting wall thereof is displacable and tiltable, and a respective one of the adjusting devices is connected to each of the supporting walls for displacing and tilting the respective wide side wall.

4. The continuous casting mold of claim 3, further comprising an articulated connection between the supporting wall and the respective adjusting device therefor.

5. The continuous casting mold of claim 3, wherein the adjusting devices are provided with electromechanical or hydraulic drives.

6. The continuous casting mold of claim 2, wherein each of the wide side walls is displaceable and tiltable and the adjusting device is connected to both of the supporting walls for displacing and tilting the wide side walls with respect to each other.

7. The continuous casting mold of claim 6, wherein the adjusting device is provided with electromechanical or hydraulic drives.

8. The continuous casting mold of claim 1, wherein the side walls together define a funnel shaped pouring-in region for the casting mold which extends in the casting direction to the end of the mold in the casting direction.

9. The continuous casting mold of claim 8, wherein there is a casting level in the casting mold under a constant casting condition in the casting mold, and in a horizontal plane incorporating the casting level under constant casting conditions, the inclination $\infty_1$ of the wide side wall of the funnel shaped pouring in region is 1° to 5° and the inclination $\infty_2$of the wide side wall in the region of adjustment of the narrow side wall is 0.1° to 0.3°.

10. The continuous casting mold of claim 8, further comprising coolant ducts for molding cooling in at least one of the wide side walls or in the supporting wall;

the coolant ducts in the funnel shaped pouring-in region of the wide side walls have a first geometry and the coolant ducts in the region of adjustment of the narrow side walls have a second different geometry.

11. The continuous casting mold of claim 8, wherein the funnel shaped pouring-in region of the wide side walls have a contour that is shaped parabolically in the casting direction.

12. The continuous casting mold of claim 8, wherein the narrow side walls have a contour that is shaped parabolically in the casting direction.

13. The continuous casting mold in claim 12, wherein the narrow side walls have edge clearances in the region thereof extending below the casting level and as far as the mold exit.

14. The continuous casting mold of claim 1, wherein the narrow side walls are positioned and oriented between the wide side walls so that the narrow side walls diverge from one another in the casting direction.

15. The continuous casting mold of claim 1, further comprising coolant ducts for mold cooling in at least one of the wide side walls or in the supporting wall.

16. The continuous casting mold of claim 15, wherein the coolant ducts comprise coolant slots along a contact plane between the supporting wall and the respective wide side wall.

17. The continuous casting mold of claim 15, wherein the coolant ducts are arranged in groups of adjacent cooling ducts, a respective individually activatable coolant supply station connected with each of the groups of adjacent coolant ducts;

at least one coolant supply station and an associated group of the coolant ducts being connected and positioned to supply coolant to the funnel shaped pouring in region and at least a second coolant supply station an associated group of the cooling ducts being connected and positioned to supply coolant to the regions of adjustments of the narrow side walls of each side wall.

18. The continuous casting mold of claim 1, further comprising a carrier wall disposed between at least one of the wide side walls and the respective supporting wall wherein the at least one wide side wall is relasably fastened to the carrier wall and the carrier wall is releasably fastened to the supporting wall.

19. The continuous casting mold of claim 18, further comprising coolant ducts for mold cooling provided in at least one of the wide side wall and the carrier wall.

20. The continuous casting mold of claim 19, wherein the coolant ducts comprise coolant slots along the contact plane between the at least one wide side wall and the one carrier wall.

21. The continuous casting mold of claim 1, wherein the wide side walls include inner walls which form the mold cavity, and the inner walls of the wide side walls are formed of different materials along the casting direction, wherein a material having lower thermal conductivity is used in the region of the wide side walls at casting level and a material of higher thermal conductivity is used in the region of the wide side walls following the region of the casting level in the casting direction.

* * * * *